US009392373B2

(12) United States Patent
Ishihara et al.

(10) Patent No.: US 9,392,373 B2
(45) **Date of Patent: *Jul. 12, 2016**

(54) ACOUSTIC GENERATOR, ACOUSTIC GENERATION DEVICE, AND ELECTRONIC DEVICE

(71) Applicant: KYOCERA Corporation, Kyoto-shi, Kyoto (JP)

(72) Inventors: Atsushi Ishihara, Kirishima (JP); Shuichi Fukuoka, Kirishima (JP); Noriyuki Kushima, Kirishima (JP); Takeshi Hirayama, Kirishima (JP); Tooru Takahashi, Kagoshima (JP); Yutaka Makino, Kirishima (JP); Hiroshi Ninomiya, Kirishima (JP)

(73) Assignee: Kyocera Corporation, Kyoto-shi, Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/410,703

(22) PCT Filed: Apr. 30, 2013

(86) PCT No.: PCT/JP2013/062651

§ 371 (c)(1),
(2) Date: Dec. 23, 2014

(87) PCT Pub. No.: WO2014/024528

PCT Pub. Date: Feb. 13, 2014

(65) Prior Publication Data

US 2015/0195657 A1 Jul. 9, 2015

(30) Foreign Application Priority Data

Aug. 10, 2012 (JP) ..... 2012-179064

(51) Int. Cl.
*H04R 17/00* (2006.01)
*H04R 1/00* (2006.01)
(Continued)

(52) U.S. Cl.
CPC ..... *H04R 17/00* (2013.01); *B06B 1/0644* (2013.01); *G10K 11/002* (2013.01); *H04R 1/00* (2013.01); *H04R 7/04* (2013.01); *H04R 2400/11* (2013.01)

(58) Field of Classification Search
CPC ..... H04R 2440/00–2440/07; H04R 2217/00–2217/03; H04R 19/00–19/01; H04R 19/013; H04R 19/016; H04R 9/048; H04R 7/04
USPC ..... 381/152, 190, 191, 299, 431.3
See application file for complete search history.

(56) References Cited

U.S. PATENT DOCUMENTS 4,654,554 A * 3/1987 Kishi ..... 381/190
5,638,456 A * 6/1997 Conley et al. ..... 381/190
(Continued)

FOREIGN PATENT DOCUMENTS

EP 2587837 A1 5/2013
JP 2009-130663 A 6/2009
(Continued)

OTHER PUBLICATIONS

International Search Report, PCT/JP2013/062651, May 27, 2013, 1 pg.
(Continued)

*Primary Examiner* — Suhan Ni
(74) *Attorney, Agent, or Firm* — Volpe and Koenig, P.C.

(57) ABSTRACT

An acoustic generator according to one embodiment includes a piezoelectric element (exciter), a vibrating portion, and a plurality of dampers. The piezoelectric element receives an input of an electrical signal and is caused to vibrate. The piezoelectric element is mounted on the vibrating portion, and the vibrating portion is caused to vibrate by the vibration of the piezoelectric element. The dampers are integrated with the vibrating portion. The dampers are asymmetrically provided with respect to an axis of symmetry of a shape delineated by the outline of the vibrating portion, in a plan view of the vibrating portion from a side on which the piezoelectric element is mounted.

18 Claims, 8 Drawing Sheets

(51) Int. Cl.

| | |
|---|---|
| ***B06B 1/06*** | (2006.01) |
| ***G10K 11/00*** | (2006.01) |
| *H04R 7/04* | (2006.01) |

(56) References Cited

U.S. PATENT DOCUMENTS

| | | | |
|---|---|---|---|
| 8,254,603 | B2 | 8/2012 | Suzuki et al. |
| 8,670,578 | B2 | 3/2014 | Onishi et al. |
| 2013/0094681 | A1 | 4/2013 | Fukuoka et al. |

FOREIGN PATENT DOCUMENTS

| | | | |
|---|---|---|---|
| JP | 4969706 | B2 | 7/2012 |
| WO | 96/01547 | A2 | 1/1996 |
| WO | 2009/110575 | A1 | 9/2009 |

OTHER PUBLICATIONS

Extended European Search Report, European Patent Application No. 13827751.2, May 16, 2016, 8 pgs.

* cited by examiner

ACOUSTIC GENERATOR, ACOUSTIC GENERATION DEVICE, AND ELECTRONIC DEVICE

CROSS-REFERENCE TO RELATED APPLICATIONS

This application is national stage application of International Application No. PCT/JP2013/062651, filed on Apr. 30, 2013, which designates the United States, incorporated herein by reference, and which claims the benefit of priority from Japanese Patent Application No. 2012-179064, filed on Aug. 10, 2012, the entire contents of which are incorporated herein by reference.

FIELD

The embodiments disclosed herein relate to an acoustic generator, an acoustic generation device, and an electronic device.

BACKGROUND

Acoustic generators using an actuator have conventionally known (for example, see Patent Literature 1). Such an acoustic generator outputs sound by applying a voltage to an actuator mounted on a vibrating plate, thereby causing the vibrating plate to vibrate.

CITATION LIST

Patent Literature

Patent Literature 1: Japanese Laid-open Patent Publication No. 2009-130663

SUMMARY

Technical Problem

Because such a conventional acoustic generator actively makes use of the resonance of the vibrating plate, the sound pressure frequency characteristics often indicate peaks (frequencies resulting in a higher sound pressure than those achieved with nearby frequencies) and dips (frequencies resulting in a lower sound pressure than those achieved with nearby frequencies), and it has been therefore difficult to achieve high quality sound.

Solution to Problem

An acoustic generator according to an aspect of an embodiment includes an exciter, a vibrating portion, and a plurality of dampers. The exciter receives an input of an electrical signal and is caused to vibrate. The exciter is mounted on the vibrating portion, and the vibrating portion is caused to vibrate by the vibration of the exciter. The plurality of dampers are integrated with the vibrating portion. The dampers are asymmetrically provided with respect to an axis of symmetry of a shape delineated by an outline of the vibrating portion, in a plan view of the vibrating portion from a side on which the exciter is mounted.

DESCRIPTION OF EMBODIMENTS

Embodiments of an acoustic generator, an acoustic generation device, and an electronic device that are disclosed by the present application will now be explained in detail with reference to the appended drawings. The embodiments described hereunder are not intended to limit the scope of the present invention in any way.

Figure 1A:
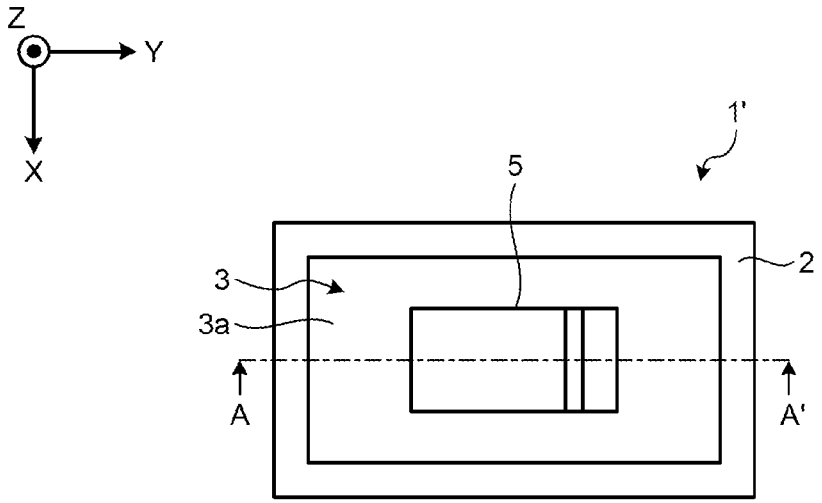
FIG. 1A is a schematic plan view of a basic acoustic generator.

Before explaining an acoustic generator 1 according to the embodiment, a general structure of a basic acoustic generator 1' will now be explained with reference to FIGS. 1A and 1B. FIG. 1A is a schematic plan view of the acoustic generator 1', and FIG. 1B is a cross sectional view along A-A' in FIG. 1A.

Figure 1B:
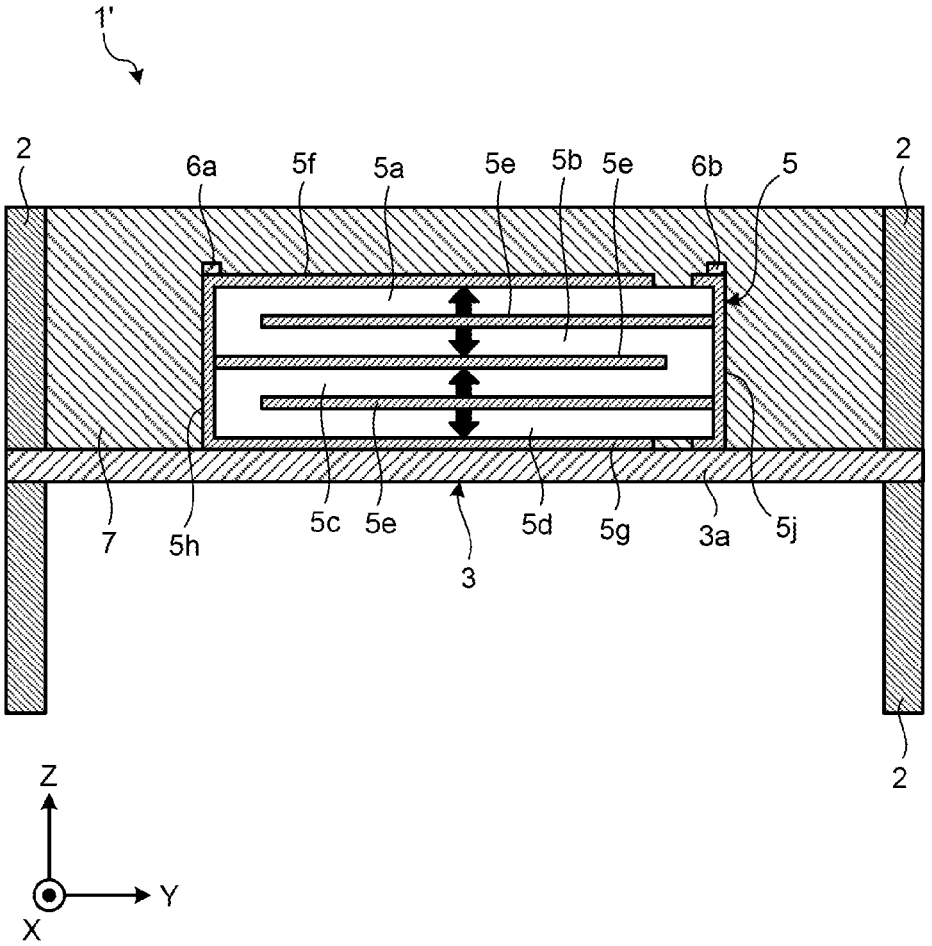
FIG. 1B is a cross sectional view along the line A-A' in FIG. 1A.

To facilitate understanding of the explanation, included in FIGS. 1A and 1B is a three-dimensional Cartesian coordinate system having a Z axis the positive direction of which extends perpendicularly upwardly and the negative direction of which extends perpendicularly downwardly. This Cartesian coordinate system is included in some of the drawings referred to in the following explanation. A resin layer 7 is omitted in FIG. 1A.

Also to facilitate understanding of the explanation, illustrated in FIG. 1B is the acoustic generator 1' the thickness direction of which (Z-axial direction) is exaggeratingly enlarged.

As illustrated in FIG. 1A, the acoustic generator 1' includes a frame 2, a vibrating plate 3, and a piezoelectric element 5. Explained below is an example in which the piezoelectric element 5 is provided in singularity as illustrated in FIG. 1A, but the number of the piezoelectric element 5 is not limited to one.

The frame 2 has two frame members having the same rectangular, frame-like shape, and nipping the ends of the vibrating plate 3 therebetween, thereby allowing the frame 2 to serve as a support for supporting the vibrating plate 3. The vibrating plate 3 has a plate-like or a film-like shape the ends of which are nipped and fixed by the frame 2. In other words, the vibrating plate 3 is supported in a manner stretched across the frame 2.

The inner portion of the vibrating plate 3, being inner with respect to the frame 2, and that is not nipped by the frame 2 and is capable of freely vibrating serves as a vibrating portion 3*a*. The vibrating portion 3*a* is an approximately rectangular portion that is on the inner side of the frame 2.

The vibrating plate 3 may be made of various types of materials, such as a resin or a metal. For example, the vibrating plate 3 may be a film made of a resin such as polyethylene or polyimide and having a thickness of 10 micrometers to 200 micrometers.

The thickness, the material, and the like of the frame 2 are not particularly limited. The frame 2 may be made of various types of materials such as a resin or a metal. For example, the frame 2 may be preferably made of stainless steel with a thickness of 100 micrometers to 1000 micrometers, from the viewpoint of mechanical strength and high corrosion resistance.

Illustrated in FIG. 1A is the frame 2 the internal area of which has an approximately rectangular shape, but the shape may also be a polygonal shape such as a parallelogram, a trapezoid, or a regular polygon. Explained in the embodiment is an example in which the frame 2 has an approximately rectangular shape, as illustrated in FIG. 1A.

The piezoelectric element 5 is provided bonded to the surface of the vibrating portion 3*a*, for example, and serves as an exciter that receives an application of a voltage and excites the vibrating portion 3*a*.

The piezoelectric element 5 includes a laminate of four piezoelectric layers 5*a*, 5*b*, 5*c*, and 5*d* that are made of ceramic and laminated alternatingly with three internal electrode layers 5*e*, surface electrode layers 5*f* and 5*g* provided on the top and the bottom surfaces of the laminate, respectively, and external electrodes 5*h* and 5*j* provided on respective sides where the internal electrode layers 5*e* are exposed, as illustrated in FIG. 1B. To the external electrodes 5*h* and 5*j*, lead terminals 6*a* and 6*b* are connected, respectively.

The piezoelectric element 5 has a plate-like shape the principal surfaces of which at the top and the bottom have a polygonal shape such as a rectangle or a square. The piezoelectric layers 5*a*, 5*b*, 5*c*, and 5*d* are polarized in the directions indicated by the arrows in FIG. 1B. In other words, the piezoelectric layers 5*a*, 5*b*, 5*c*, and 5*d* are polarized in opposite directions on one side and the other side in the thickness direction (Z-axial direction in FIG. 1B), with respect to the direction of the electric field applied at a particular moment.

When a voltage is applied to the piezoelectric element via the lead terminals 6*a* and 6*b*, the piezoelectric layers 5*c* and 5*d* on the side bonded on the vibrating portion 3*a* deform by shrinking, and the piezoelectric layers 5*a* and 5*b* on the top surface side of the piezoelectric element 5 deform by stretching, for examples, at one particular moment. By applying an alternating-current signal to the piezoelectric element, therefore, the piezoelectric element 5 is caused to bend and vibrate, thereby causing the vibrating portion 3*a* to bend and vibrate.

A principal surface of the piezoelectric element 5 is bonded to a principal surface of the vibrating portion 3*a* using an adhesive such as epoxy-based resin.

Examples of materials with which the piezoelectric layers 5*a*, 5*b*, 5*c*, and 5*d* are formed include lead-free piezoelectric materials such as lead zirconate titanate (PZT), a Bi-layered ferroelectric compound, a tungsten bronze structure compound, and a piezoelectric ceramic conventionally used.

Various types of metallic materials may be used for the internal electrode layers 5*e*. When a material with a metallic component consisting of silver and palladium, and a ceramic component used in the piezoelectric layers 5*a*, 5*b*, 5*c*, and 5*d*, for example, a stress caused by the difference in the thermal expansions in the piezoelectric layers 5*a*, 5*b*, 5*c*, and 5*d* and the internal electrode layers 5*e* can be reduced, so that the piezoelectric element 5 with no defective lamination can be achieved.

The lead terminals 6*a* and 6*b* may be made of various types of metallic materials. When the lead terminals 6*a* and 6*b* are provided using flexible wiring in which a foil made of a metal such as copper or aluminum is interposed between resin films, for example, a low-profile piezoelectric element 5 can be provided.

The acoustic generator 1' also includes, as illustrated in FIG. 1B, a resin layer 7 that is provided covering the piezoelectric element 5 and the surface of the vibrating plate 3 on the inner side of the frame 2, and is integrated with the vibrating plate 3 and the piezoelectric element 5.

For the resin layer 7, a material such as an acrylic-based resin may be used, and the resin layer 7 is preferably formed in such a manner that a Young's modulus within a range from 1 megapascal to 1 gigapascal is achieved. By embedding the piezoelectric element 5 in the resin layer 7, an appropriate level of damper effect can be achieved, so that the resonance can be suppressed and the peaks and the dips in the sound pressure frequency characteristics can be reduced.

Furthermore, illustrated in FIG. 1B is an example in which the resin layer 7 is provided to the same height as the height of the frame 2, but the resin layer 7 may be provided to any height as long as the piezoelectric element 5 is embedded in the resin layer 7. For example, the resin layer 7 may be provided to a height that is higher than the height of the frame 2.

Illustrated in FIG. 1B is an example in which the piezoelectric element 5 is a laminated bimorph piezoelectric element, but the piezoelectric element 5 is not limited thereto. For example, the piezoelectric element 5 may be a unimorph piezoelectric element that is a deformable piezoelectric element bonded to the vibrating portion 3*a*.

Illustrated in FIG. 1A is the acoustic generator 1' in which the piezoelectric element 5 is positioned sharing approximately the same centroid with the vibrating portion 3*a*. A composite vibrating portion including the vibrating portion 3*a*, the piezoelectric element 5, and the resin layer 7 having such a configuration has symmetry as a whole.

However, because such an acoustic generator 1' actively making use of resonance is symmetrically configured, the peaks concentrate and degenerate at a certain frequency, as illustrated in FIG. 2, so that the peaks and the dips tend to become steep.

Figure 2A:
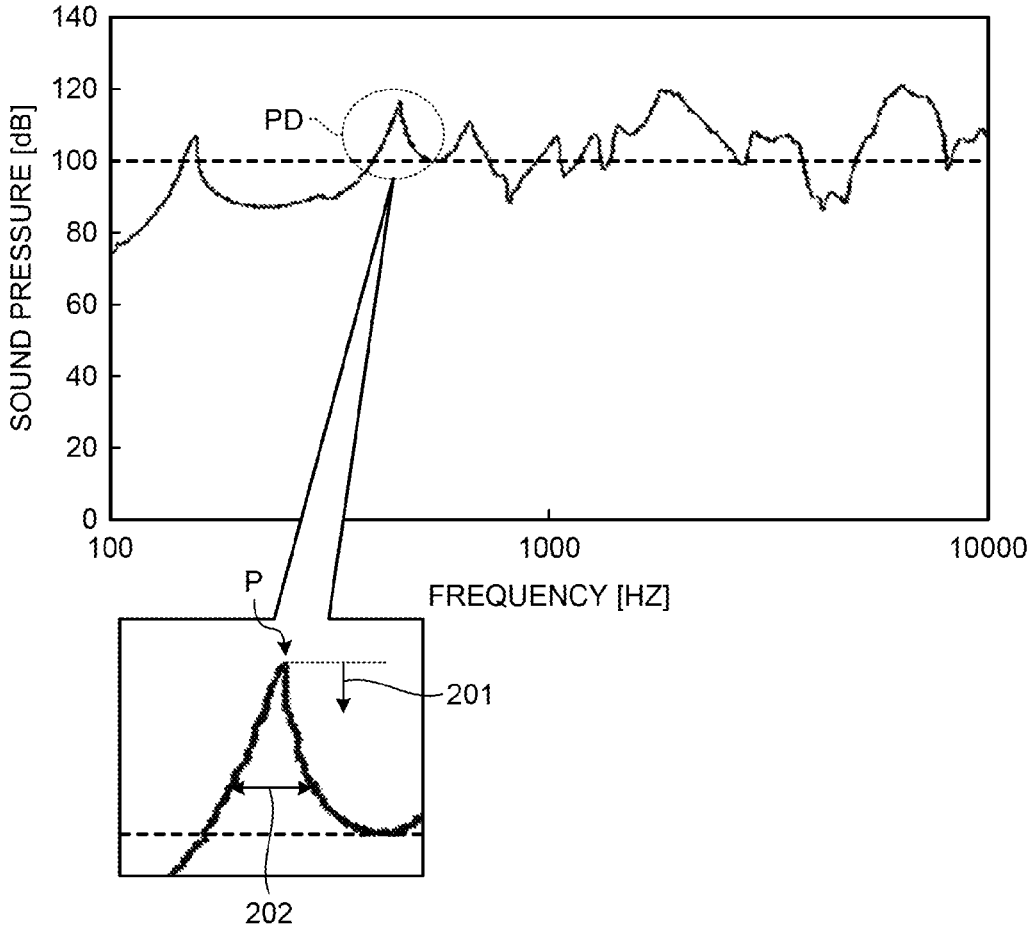
FIG. 2A is a schematic illustrating an example of sound pressure frequency characteristics.

This point is illustrated in FIG. 2A. FIG. 2A is a schematic illustrating an example of sound pressure frequency characteristics. When the entire composite vibrating portion including the piezoelectric element 5, and consisting of the vibrating portion 3*a*, the piezoelectric element 5, and the resin layer 7 is symmetrically configured, as illustrated in FIG. 1A mentioned earlier, for example, the peaks concentrate and degenerate at a certain frequency, as illustrated in FIG. 2A, so that the peaks and the dips tend to become steep.

As an example, let us focus on the portion surrounded by the closed curve PD drawn with a dotted line in FIG. 2A. With such a peak, the sound pressure becomes varied depending on the frequency, so that it becomes difficult to achieve high-quality sound.

In such a case, it is effective to take an approach of reducing the height of the peak P (see the arrow 201 in FIG. 2A), and of increasing the peak width (see the arrow 202 in FIG. 2A) so that the difference between the peak P and the dip at the resonance frequency is reduced, as illustrated in FIG. 2A.

In the embodiment, therefore, the height of the peak P is reduced, to begin with, by providing a damper 8, giving a mechanical vibration loss to the vibrating portion 3*a* thereby.

Furthermore, in the embodiment, the dampers 8 are provided in such a manner that the composite vibrating portion including the vibrating portion 3*a*, the piezoelectric element 5, the resin layer 7, and the dampers 8 becomes asymmetric as a whole, so that the degenerate resonance mode is distributed to resonance modes exhibiting similar symmetry.

Figure 2B:
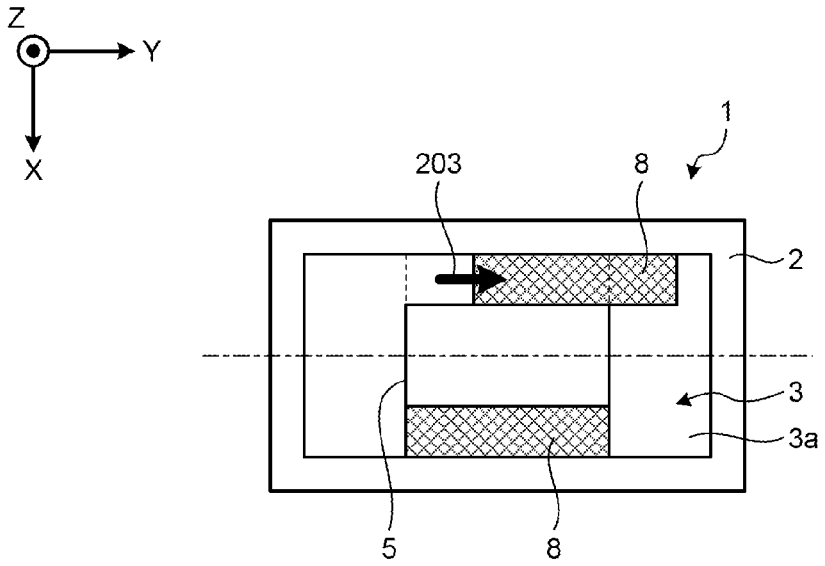
FIG. 2B is a schematic plan view illustrating a structure of an acoustic generator according to one embodiment.

This point will now be explained specifically with reference to FIG. 2B. FIG. 2B is a schematic plan view illustrating a structure of the acoustic generator 1 according to one embodiment of the present invention. The resin layer 7 is omitted in FIG. 2B. As illustrated in FIG. 2B, the acoustic generator 1 includes a plurality of dampers 8, in addition to the elements included in the acoustic generator 1' illustrated in FIGS. 1A and 1B.

Illustrated in FIG. 2B is an example that is provided with two dampers 8, but the number is not limited to two. In the examples described in the embodiment, the acoustic generator 1 has two dampers 8 with the same shape, unless specified otherwise.

Each of the dampers 8 may be any member that gives a mechanical loss, but is preferably a member the mechanical loss coefficient of which is high, that is, the mechanical quality factor of which (what is called a mechanical Q) is low. Such dampers 8 may be made of various types of elastic materials, but because it is preferable for the dampers 8 to be soft and to deform easily, the dampers 8 is preferably made of a rubber material such as urethane rubber. A porous rubber material such as urethane foam is particularly preferable. The dampers 8 are mounted on the surface of the resin layer 7 illustrated in FIG. 1B, and are integrated with the vibrating portion 3*a*, the piezoelectric element 5, and the resin layer 7. Being "integrated" herein means that such elements are configured to vibrate integrally.

By providing the dampers 8 in the manner described above, the areas of the vibrating portion 3*a* where the dampers 8 are positioned become subject to the vibration loss attributable to the dampers 8 via the resin layer 7, and the resonance is suppressed thereby.

Furthermore, in the embodiment, the dampers 8 are provided in such a manner that the composite vibrating portion including the vibrating portion 3*a*, the piezoelectric element 5, the resin layer 7, and the dampers 8 becomes asymmetric as a whole.

Specifically, the dampers 8 are mounted on the vibrating portion 3*a* in such a manner that the dampers 8 are asymmetric to each other with respect to an axis of symmetry of a shape delineated by the outline of the vibrating portion 3*a* (that is the same as the shape delineated by the inner outline of the frame 2) in a plan view from a side of the vibrating portion 3*a* on which the piezoelectric element 5 that is the exciter is mounted, that is, from a direction perpendicular to the principal surfaces of the vibrating portion 3*a* (from the thickness direction of the vibrating portion 3*a*, and from the Z-axial direction in FIG. 2B). More specifically, as illustrated in FIG. 2B, for example, one of the dampers 8 is provided at a position offset from the symmetric position illustrated with a rectangle in a dotted line, with respect to the longitudinal axis of symmetry of the vibrating portion 3*a* (see the arrow 203 in FIG. 2B). Hereinafter, when a something is viewed in a plan view, the thing is looked down from the side of the vibrating portion 3*a* on which the piezoelectric element 5 that is the exciter is mounted, that is, from the direction perpendicular to the principal surfaces of the vibrating portion 3*a* (from the thickness direction of the vibrating portion 3*a*, and from the Z-axial direction in FIG. 2B).

In this manner, a plurality of dampers 8 can be mounted on the vibrating portion 3*a* asymmetrically to each other with respect to both of the two axes of symmetry of the vibrating portion 3*a* (the longitudinal axis of symmetry illustrated with a dot-dash line in FIG. 2B and a width-direction axis of symmetry perpendicular to the longitudinal axis of symmetry).

Hereinafter, the "axes of symmetry of the vibrating portion 3*a*" represent the axes of symmetry of the shape delineated by the outline of the vibrating portion 3*a* in a plan view of the vibrating portion 3*a* from the direction perpendicular to the principal surfaces of the vibrating portion 3*a*. Being "asymmetric with respect to the axes of symmetry of the vibrating portion 3*a*" means being asymmetric with respect to all of the axes of symmetry of the vibrating portion 3*a*.

By mounting a plurality of dampers 8 on the vibrating portion 3*a* asymmetrically with respect to the axes of symmetry of the vibrating portion 3*a*, the composite vibrating portion including the vibrating portion 3*a*, the piezoelectric element 5, the resin layer 7, and the dampers 8 can be asymmetrically configured as a whole. In this manner, the degeneracy of the resonance modes can be broken, and the degenerate resonance mode can be distributed to a plurality of resonance modes exhibiting similar symmetry.

Furthermore, the interference between the distributed resonance modes allows the height of the peak P to be lowered (see the arrow 201 in FIG. 2A), and the peak width to be increased (see the arrow 202 in FIG. 2A).

In this manner, the levels of the peaks P in resonance frequency can be lowered, so that excellent sound pressure frequency characteristics varying less can be achieved. In particular, the sound pressure frequency characteristics in the midrange can be made near flat, so that excellent sound quality can be achieved.

An exemplary layout of the dampers 8 for reducing the symmetry of the composite vibrating portion including the vibrating portion 3*a*, the piezoelectric element 5, the resin layer 7, and the dampers 8 is not limited to that illustrated in FIG. 2B. Other exemplary layouts of the dampers 8 will be explained later with reference to FIGS. 3 to 4B.

The symmetry of the composite vibrating portion including the vibrating portion 3*a*, the piezoelectric element 5, the resin layer 7, and the dampers 8 can also be reduced by making the shape or the thickness of the dampers 8 different. The details of these devises will be explained later with reference to FIGS. 5A to 6B.

The exemplary layout of the dampers 8 for reducing the symmetry of the composite vibrating portion including the vibrating portion 3*a*, the piezoelectric element 5, the resin layer 7, and the dampers 8 will now be explained one by one, with reference to FIGS. 3 to 6B. In FIGS. 3 to 6B, the members of the acoustic generator 1 including the piezoelectric element 5 are sometimes illustrated in a quite simplified manner. In the FIGS. 3 to 6B, the resin layer 7 is omitted.

Figure 3:
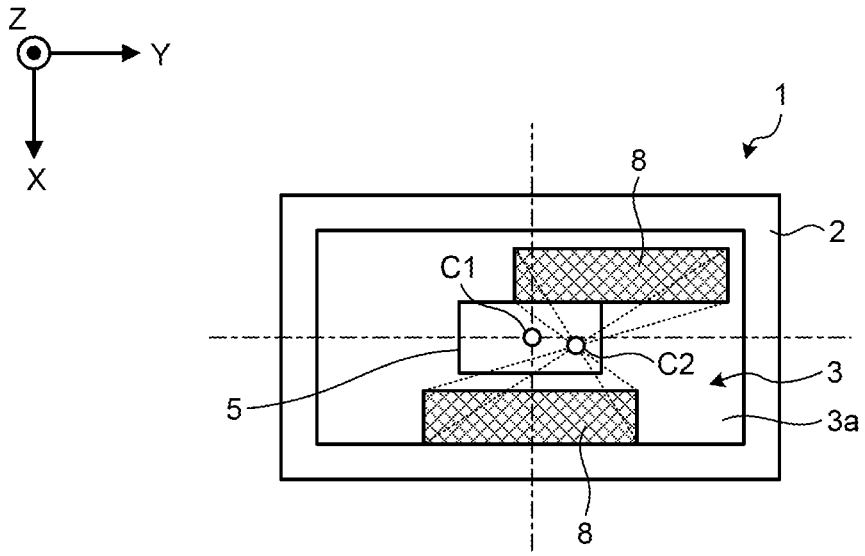
FIG. 3 is a first schematic plan view illustrating an example of the damper layout.

To begin with, FIG. 3 is a first schematic plan view illustrating an exemplary layout of the dampers 8. As illustrated in FIG. 3, two dampers 8 are positioned in such a manner that the center of symmetry C2 of these dampers 8 is positioned offset from the centroid C1 of the vibrating portion 3*a*, thereby reducing the symmetry of the composite vibrating portion including the vibrating portion 3*a*, the piezoelectric element 5, the resin layer 7, and a plurality of the dampers 8.

In this layout, a plurality of dampers 8 are mounted on the vibrating portion 3*a* asymmetrically to each other with respect to the centroid C1 of the shape delineated by the outline of the vibrating portion 3*a* in a plan view of the vibrating portion 3*a*.

This layout allows the degenerate resonance mode to be distributed to resonance modes exhibiting similar symmetry, as mentioned earlier with reference to FIG. 2B, so that the acoustic generator 1 can achieve excellent sound pressure frequency characteristics that vary smoothly.

Figure 4A:
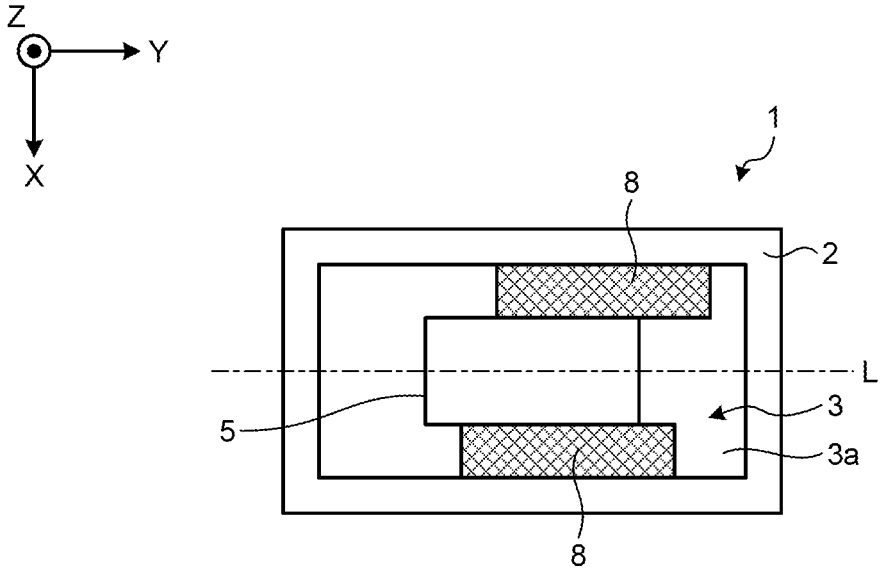
FIG. 4A is a second schematic plan view illustrating an example of the damper layout.
Figure 4B:
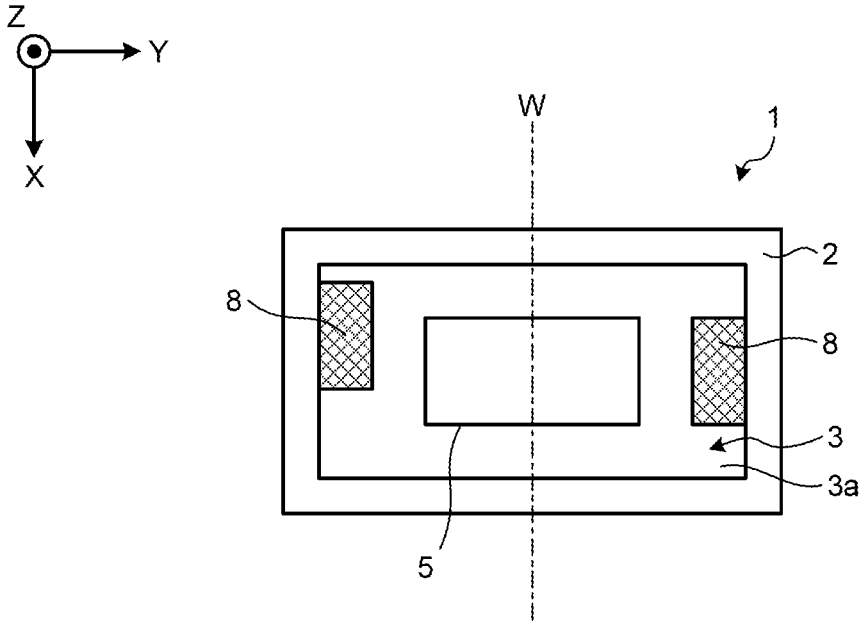
FIG. 4B is a third schematic plan view illustrating an example of the damper layout.

The exemplary layouts illustrated in FIGS. 4A and 4B will now be explained. FIGS. 4A and 4B are second and third schematic plan views illustrating exemplary layouts of the dampers 8.

FIG. 4A illustrates the longitudinal axis of symmetry of the vibrating portion 3*a* as an axis of symmetry L, and FIG. 4B illustrates the short-direction axis of symmetry of the vibrating portion 3*a* as an axis of symmetry W. These axes of symmetry L and W are sometimes illustrated in other drawings referred to in the explanation below.

As illustrated in FIG. 4A, two dampers 8 are asymmetrically positioned to each other with respect to the longitudinal axis of symmetry L of the vibrating portion 3*a*, so that the symmetry of the composite vibrating portion including the vibrating portion 3*a*, the piezoelectric element 5, the resin layer 7, and the dampers 8 can be reduced.

The example illustrated in FIG. 4A is the same as the example illustrated in FIG. 2B in that the dampers 8 are asymmetrically positioned to each other with respect to the longitudinal axis of symmetry L, but both of the dampers 8 are offset from the symmetrical positions in FIG. 4A, instead of one of the dampers 8, unlike the example illustrated in FIG. 2B.

As illustrated in FIG. 4B, two dampers 8 are asymmetrically positioned to each other with respect to the short-direction axis of symmetry W of the vibrating portion 3*a*, so that the symmetry of the composite vibrating portion including the vibrating portion 3*a*, the piezoelectric element 5, the resin layer 7, and the dampers 8 can be reduced.

In the examples illustrated in FIGS. 3, 4A, and 4B, the dampers 8 are asymmetrically positioned with respect to both of the two axes of symmetry of the vibrating portion 3*a*.

Figure 5A:
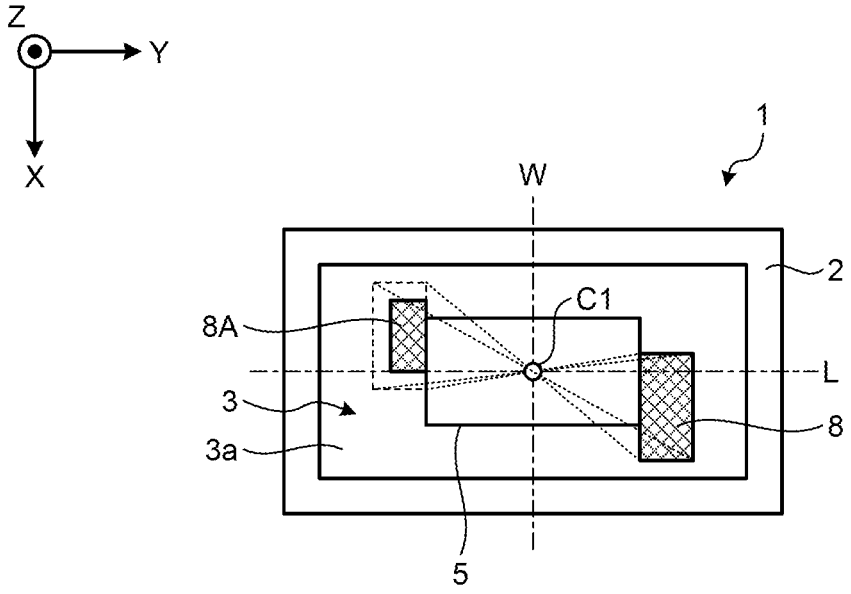
FIG. 5A is a fourth schematic plan view illustrating an example of the damper layout.
Figure 5B:
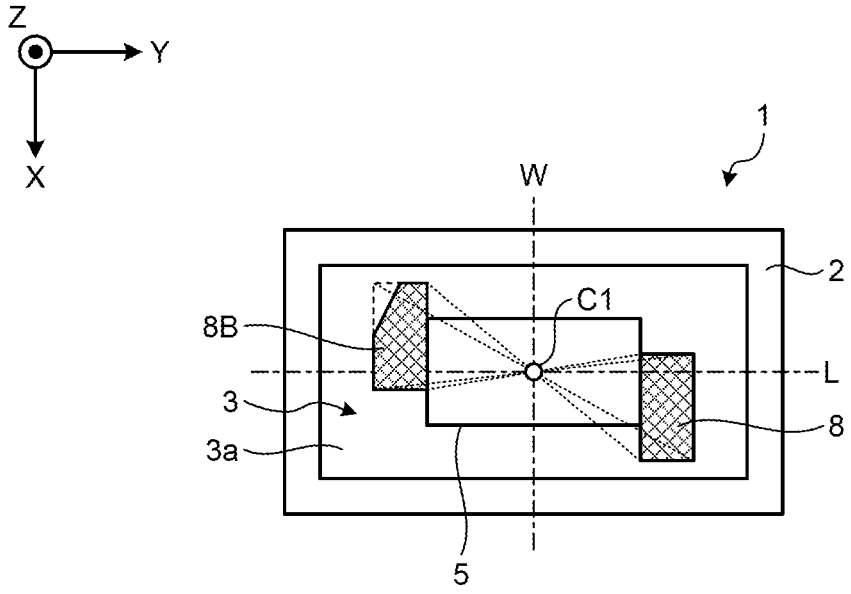
FIG. 5B is a fifth schematic plan view illustrating an example of the damper layout.

The exemplary layouts illustrated in FIGS. 5A and 5B will now be explained. FIGS. 5A and 5B are fourth and fifth schematic plan views illustrating exemplary layouts of the dampers 8.

As illustrated in FIG. 5A, assumed in this example is a layout in which the two dampers 8 are point-symmetric to each other with respect to the centroid C1 of the vibrating portion 3*a*. One of the dampers 8 under this assumption is illustrated as a rectangle in a dotted line, with no reference numeral, in FIG. 5A.

Under such an assumption, the two dampers 8 are symmetrically positioned with respect to the centroid C1 of the vibrating portion 3*a*. The symmetry of the composite vibrating portion including the vibrating portion 3*a*, the piezoelectric element 5, the resin layer 7, and the dampers 8 can be reduced by providing, for example, a damper 8A that is one of the dampers illustrated in a dotted line and the area of which is smaller than the area of the other damper 8 in a plan view.

As illustrated in FIG. 5B, a damper 8B, which is one of the dampers and illustrated in a dotted line under the same assumption as FIG. 5A, has a different shape from the other damper 8 in a plan view, so that the symmetry of the composite vibrating portion including the vibrating portion 3*a*, the piezoelectric element 5, the resin layer 7, and the dampers 8 can be reduced.

In this manner, by providing at least one of the dampers 8 with a different shape in a plan view (the shape in a plan view of the damper 8 from a direction perpendicular to the principal surfaces of the vibrating portion 3*a*) from the shape of the other damper 8 in a plan view, the symmetry of the composite vibrating portion including the vibrating portion 3*a*, the piezoelectric element 5, the resin layer 7, and the dampers 8 can be reduced. In this manner, the degeneracy of the resonance modes can be broken, and the degenerate resonance mode can be distributed, so that the acoustic generator 1 with excellent sound pressure frequency characteristics in which sound pressure varies less can be achieved.

Illustrated in FIGS. 5A and 5B is an example in which the shape of one of the dampers 8 in a plan view is changed from the configuration in which the two dampers 8 are positioned symmetrically with respect to the center of gravity C1 of the vibrating portion 3*a*. The shape of the dampers 8 in a plan view may also be made different in a layout in which the vibrating portion 3*a* is asymmetric to begin with, because of the positioning of the dampers 8.

Figure 6A:
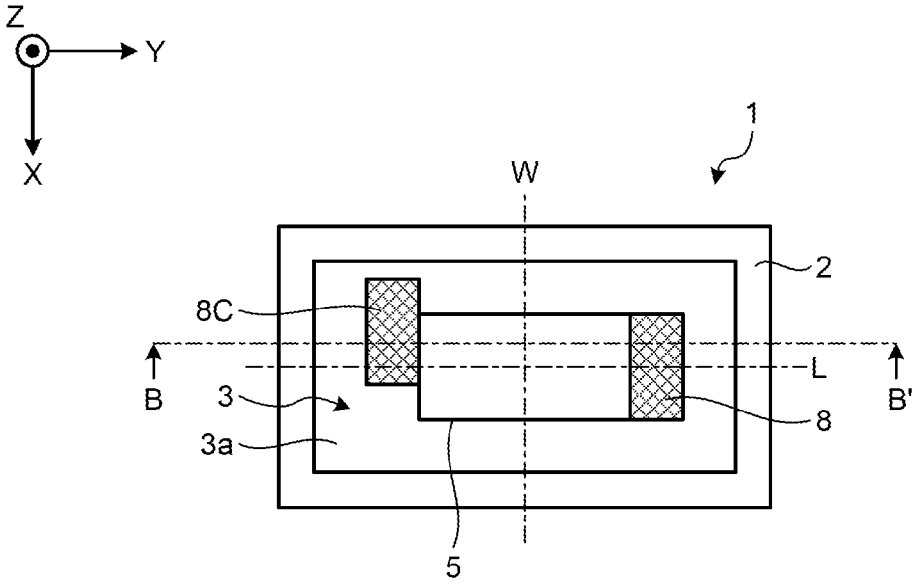
FIG. 6A is a sixth schematic plan view illustrating an example of the damper layout.

The exemplary layouts illustrated in FIGS. 6A and 68 will now be explained. FIG. 6A is a sixth schematic plan view illustrating an exemplary layout of the dampers 8, and FIG. 6B is a cross sectional view along the line B-B' in FIG. 6A.

A damper 8C and the damper 8 are asymmetrically positioned, in the same manner as in the layouts described above, with respect to the axis of symmetry and the centroid of the vibrating portion 3*a*, as illustrated in FIG. 6A.

Figure 6B:
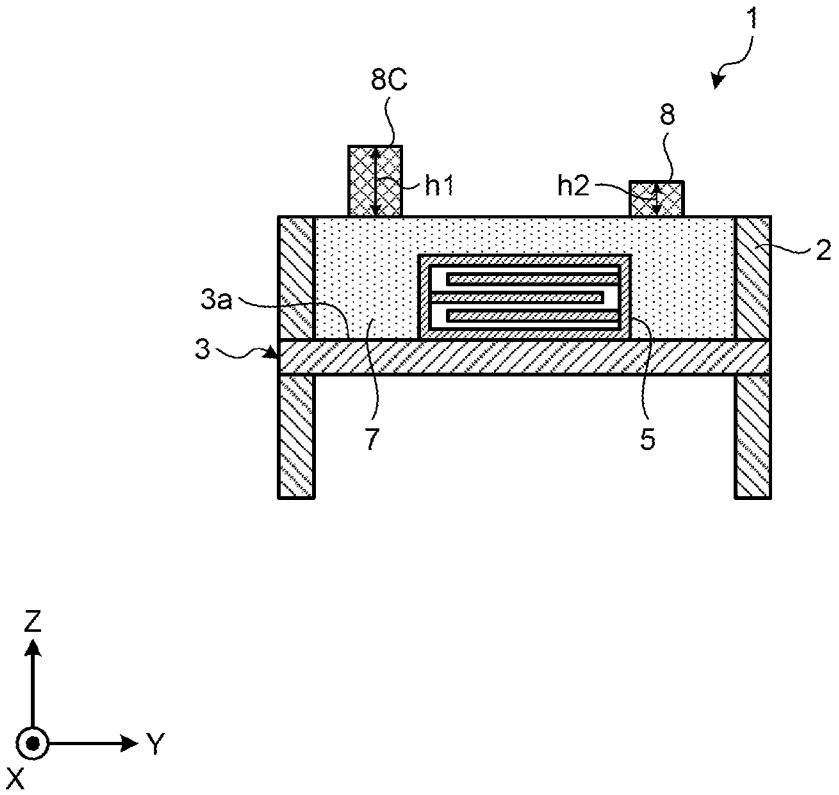
FIG. 6B is a cross sectional view along the line B-B' in FIG. 6A.

In this layout, the damper 8C may have a thickness h1 that is different from the thickness h2 of the damper 8, as illustrated in FIG. 6B.

In such a case, the mass (and mass distribution) of the damper 8C can be made different from that of the damper 8, so that the vibration losses attributable to the damper 8C and the damper 8 can be made different. In this manner, the degeneracy of the resonance modes can be broken, and the degenerate resonance mode can be distributed, so that the acoustic generator 1 with excellent sound pressure frequency characteristics can be achieved.

In the manner described above, by making the thickness of at least one of the dampers 8 different from that of the other damper 8, an acoustic generator with excellent sound pressure frequency characteristics can be achieved. In this configuration, a plurality of the dampers 8 may be symmetrically positioned in a plan view.

Figure 7:
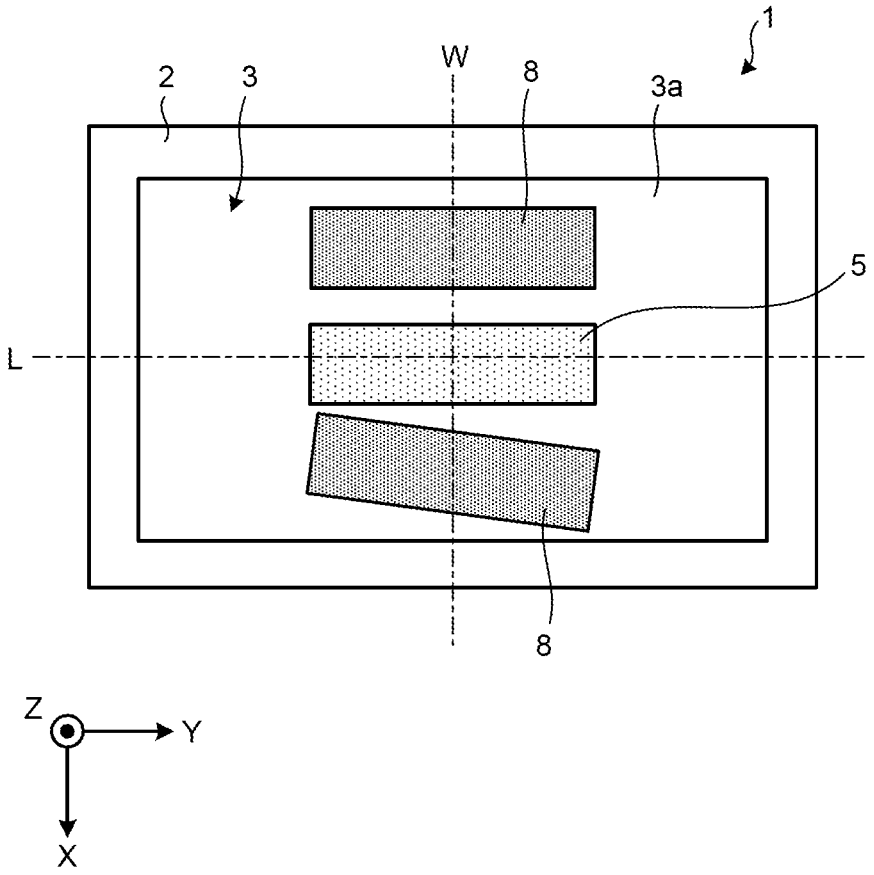
FIG. 7 is a seventh schematic plan view illustrating an example of the damper layout.

The exemplary layout illustrated in FIG. 7 will now be explained. FIG. 7 is a seventh schematic plan view illustrating an exemplary layout of the dampers 8.

In the exemplary layout illustrated in FIG. 7, at least one of the dampers 8 is positioned inclined with respect to the other damper 8. Specifically, looking down on these dampers 8 from the side on which the piezoelectric element 5 that is the exciter is mounted on the vibrating portion 3*a* (from the Z-axial direction in FIG. 7), these two dampers 8 have the same anisotropic shape (a shape that is not completely isotropic like a circle). One of the dampers 8 is positioned inclined with respect to the other damper 8, looking down from the Z-axial direction in FIG. 7. In this manner, these two dampers 8 is asymmetrically positioned to each other with respect to the axes of symmetry of the shape delineated by the outline of the vibrating portion 3*a* in a plan view of the vibrating portion 3*a* from the Z-axial direction in FIG. 7.

Figure 8A:
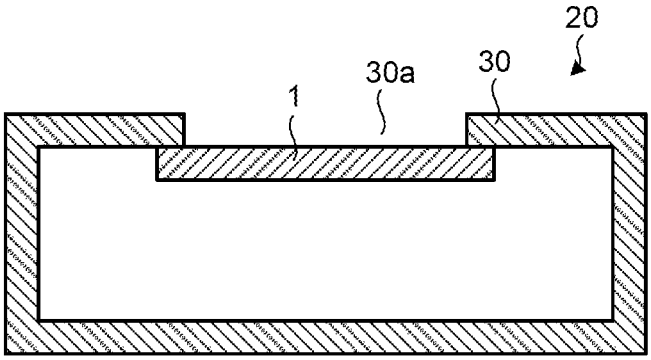
FIG. 8A is a schematic cross sectional view illustrating a configuration of an acoustic generation device according to an embodiment.
Figure 8B:
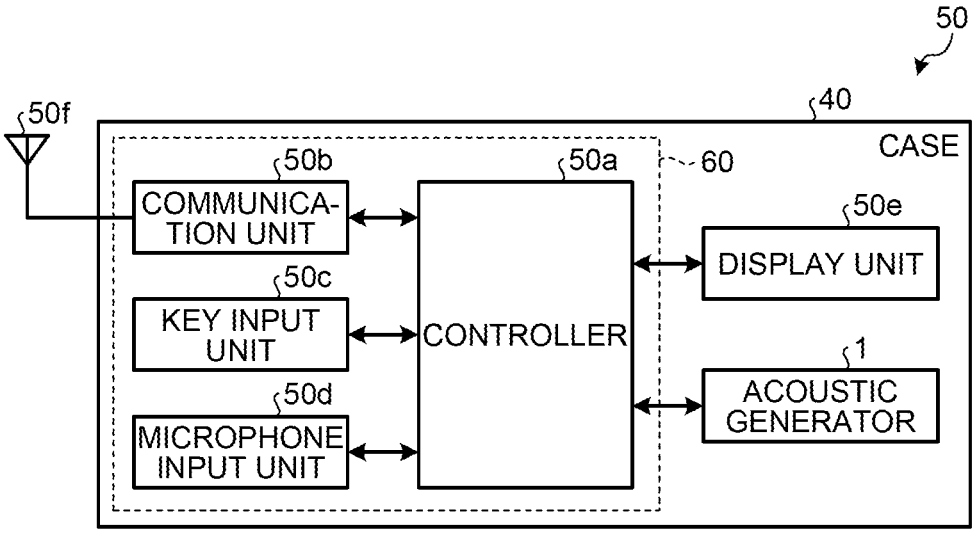
FIG. 8B is a schematic illustrating a configuration of an electronic device according to an embodiment.

Explained now with reference to FIGS. 8A and 8B are an acoustic generation device and an electronic device including the exemplary acoustic generator 1 according to the embodiment explained above. FIG. 8A is a schematic illustrating a structure of an acoustic generation device 20 according to an embodiment, and FIG. 8B is a schematic illustrating a configuration of an electronic device 50 according to an embodiment. In these drawings, only the components required in the explanations are illustrated, and a detailed configuration of and a general components of the acoustic generator 1 are omitted.

The acoustic generation device 20 is an acoustic generator such as what is called a speaker, and includes, for example, a housing 30 and the acoustic generator 1 mounted on the housing 30, as illustrated in FIG. 8A. The housing 30 has a box-like cuboid shape, and an opening 30*a* is formed on one surface of the housing 30. The housing 30 can be made using a known material such as plastic, metal, or wood. The shape of the housing 30 is not limited to a box-like cuboid shape, and may be a different shape, including a cylinder and a truncated cone.

The acoustic generator 1 is mounted on the opening 30*a* on the housing 30. The acoustic generation device 20 having such a structure can resonate the sound generated by the acoustic generator 1 inside of the housing 30, so that the sound pressure in the low-frequency range, for example, can be increased. The location where the acoustic generator 1 is mounted may be set freely. The acoustic generator 1 may be mounted on the housing 30 with another object interposed between the acoustic generator 1 and the housing 30.

The acoustic generator 1 may be installed in different types of electronic devices 50. For example, in FIG. 8B described below, the electronic device 50 is explained to be a mobile electronic device, such as a mobile phone or a tablet terminal.

As illustrated in FIG. 8B, the electronic device 50 includes an electronic circuit 60. The electronic circuit 60 includes, for example, a controller 50*a*, a communication unit 50*b*, a key input unit 50*c*, and a microphone input unit 50*d*. The electronic circuit 60 is connected to the acoustic generator 1, and serves to output an audio signal to the acoustic generator 1. The acoustic generator 1 generates sound based on the audio signal received from the electronic circuit 60.

The electronic device 50 also includes a display unit 50*e*, an antenna 50*f*, and the acoustic generator 1. The electronic device 50 also includes a case 40 in which these devices are housed.

In FIG. 8B, all of these devices, including the controller 50*a*, are illustrated to be housed in one case 40, but the way in which the devices are housed is not limited thereto. In the embodiment, the arrangement of the other components may be set freely as long as at least the acoustic generator 1 is mounted on the case 40 directly or with some object interposed between the acoustic generator 1 and the case 40.

The controller 50*a* is a control unit for the electronic device 50. The communication unit 50*b* exchanges data, for example, via the antenna 50*f*, based on the control of the controller 50*a*.

The key input unit 50*c* is an input device for the electronic device 50, and receives operations of key inputs performed by an operator. The microphone input unit 50*d* is also an input device for the electronic device 50, and receives operations of voice inputs of an operator.

The display unit 50*e* is a display output device for the electronic device 50, and outputs information to be displayed based on the control of the controller 50*a*.

The acoustic generator 1 operates as a sound output device in the electronic device 50. The acoustic generator 1 is connected to the controller 50*a* in the electronic circuit 60, and receives an application of a voltage controlled by the controller 50*a* and outputs sound.

Explained with reference to FIG. 8B is an example in which the electronic device 50 is a mobile electronic device, but the type of the electronic device 50 is not limited thereto, and may be used in various types of consumer devices having a function of generating sound. The electronic device 50 may be a flat television or a car stereo system, for example, and may be used in various types of products with a function outputting sound, such as those with a function of "speaking", examples of which include a vacuum cleaner, a washing machine, a refrigerator, and a microwave oven.

Mainly explained in the embodiment described above is an example in which the piezoelectric element 5 is provided on one principal surface of the vibrating portion 3*a*, but the configuration is not limited thereto, and the piezoelectric element 5 may be provided on both surfaces of the vibrating portion 3*a*.

Explained in the embodiment is an example in which the area on the inner side of the frame 2 has a polygonal shape such as an approximately rectangular shape. The shape of the portion is, however, not limited thereto, and may be a circle or an oval.

Furthermore, explained in the embodiment above is an example in which the dampers 8 are positioned between the frame 2 and the piezoelectric element 5 in a plan view, but the layout is not limited thereto, and the dampers 8 may be positioned overlapping with the frame 2 or the piezoelectric element 5.

Furthermore, explained in the embodiment above is an example in which the dampers 8 are integrated with the vibrating portion 3*a*, the piezoelectric element 5, and the resin layer 7, by mounting the dampers 8 on the surface of the resin layer 7, but the integration is not limited thereto. Alternatively, the dampers 8 may be integrated by mounting the dampers 8 directly on the surface of the vibrating portion 3*a*.

Furthermore, explained in the embodiment described above is an example in which the resin layer 7 is formed to cover the piezoelectric element 5 and the vibrating portion 3*a* in the frame 2, but the resin layer 7 does not necessarily be provided.

Furthermore, explained in the embodiment described above is an example in which the support for supporting the vibrating portion 3*a* is the frame 2, and supports the ends of the vibrating portion 3*a*, but the support is not limited thereto. For example, the support may support only the two ends of the vibrating portion 3*a* in the longitudinal direction or the short direction.

Furthermore, explained in the embodiment described above is an example in which the exciter is the piezoelectric element 5, but the exciter is not limited to a piezoelectric element 5, and may be any exciter having a function of receiving an electrical signal and causing vibration. The exciter may be, for example, an electrodynamic exciter, an electrostatic exciter, or an electromagnetic exciter that are known exciters causing a speaker to vibrate. An electrodynamic exciter applies a current to a coil positioned between magnetic poles of permanent magnets, and causes the coil to vibrate. An electrostatic exciter applies a bias and an electrical signal to two metal plates facing each other, and causes the metal plates to vibrate. An electromagnetic exciter supplies an electrical signal to a coil, and causes a thin steel sheet to vibrate.

Furthermore, explained in the embodiment described above is an example in which a plurality of dampers 8 are mounted on the vibrating portion 3*a* asymmetrically with respect to all of the axes of symmetry of the shape delineated by the outline of the vibrating portion 3*a* in a plan view of the vibrating portion 3*a*, and asymmetrically with respect to the centroid C1 of the shape delineated by the outline of the vibrating portion 3*a* in a plan view of the vibrating portion 3*a*, but the layout is not limited thereto. As long as the dampers 8 are asymmetrically positioned to each other with respect to all of the axes of symmetry of the shape delineated by the outline of the vibrating portion 3*a* in a plan view of the vibrating portion 3*a*, the advantageous effects can be achieved, even when the dampers 8 are symmetrically positioned with respect to the centroid C1 of the shape delineated by the outline of the vibrating portion 3*a* in a plan view of the vibrating portion 3*a*.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

The invention claimed is:

1. An acoustic generator comprising:

an exciter;

a vibrating portion on which the exciter is mounted;

a resin layer provided on the vibrating portion so as to cover the exciter; and a plurality of dampers that are provided on the vibrating portion, wherein the dampers are asymmetrically provided with respect to an axis of symmetry of a shape delineated by an outline of the vibrating portion, in a plan view of the vibrating portion from a side on which the exciter is mounted.

2. The acoustic generator according to claim 1, wherein the dampers are asymmetrically provided with respect to center of gravity of the shape delineated by the outline of the vibrating portion in the plan view of the vibrating portion from the side on which the exciter is mounted.

3. The acoustic generator according to claim 1, wherein at least one of the dampers has a shape that is different from a shape of the other dampers, in a view looking down on the vibrating portion from the side on which the exciter is mounted.

4. The acoustic generator according to claim 1, wherein at least one of the dampers has a point-asymmetric shape, in a view looking down on the vibrating portion from the side on which the exciter is mounted.

5. The acoustic generator according to claim 1, wherein at least one of the dampers has a thickness that is different from a thickness of the other dampers.

6. The acoustic generator according to claim 1, wherein at least two of the dampers have a same anisotropic shape, and one of the dampers is positioned inclined with respect to the other, in a view looking down on the vibrating portion from the side on which the exciter is mounted.

7. The acoustic generator according to claim 1, wherein the resin layer further covers a surface of the vibrating portion on which the exciter is mounted, and is integrated with the vibrating portion and the exciter, and the dampers are mounted on a surface of the resin layer, and integrated with the vibrating portion, the exciter, and the resin layer.

8. An acoustic generation device comprising:

a housing; and the acoustic generator according to claim 1 installed in the housing.

9. An electronic device comprising:

a case;

the acoustic generator according to claim 1 installed in the case; and an electronic circuit that is connected to the acoustic generator, wherein the electronic device has a function of causing the acoustic generator to generate sound.

10. An acoustic generator comprising:

an exciter;

a vibrating portion on which the exciter is mounted;

a resin layer provided on the vibrating portion so as to cover the exciter; and a plurality of dampers, wherein the dampers are asymmetrically provided with respect to an axis of symmetry of a shape of an outline of the vibrating portion in a plan view.

11. The acoustic generator according to claim 10, wherein the dampers are asymmetrically provided with respect to center of gravity of the shape of the outline of the vibrating portion.

12. The acoustic generator according to claim 10, wherein at least one of the dampers has a shape that is different from a shape of the other dampers, in a view looking down on the vibrating portion from the side on which the exciter is mounted.

13. The acoustic generator according to claim 10, wherein at least one of the dampers has a point-asymmetric shape, in a view looking down on the vibrating portion from the side on which the exciter is mounted.

14. The acoustic generator according to claim 10, wherein at least one of the dampers has a thickness that is different from a thickness of the other dampers.

15. The acoustic generator according to claim 10, wherein the dampers include a first damper and a second damper, the first damper and the second damper have a same anisotropic shape, and the first damper is positioned inclined with respect to the second damper in a view looking down on the vibrating portion from the side on which the exciter is mounted.

16. The acoustic generator according to claim 10, wherein the resin layer further covers a surface of the vibrating portion on which the exciter is mounted, and is integrated with the vibrating portion and the exciter, and the dampers are mounted on a surface of the resin layer, and integrated with the vibrating portion, the exciter, and the resin layer.

17. An acoustic generation device comprising:

a housing; and the acoustic generator according to claim 10 installed in the housing.

18. An electronic device comprising:

a case;

the acoustic generator according to claim 10 installed in the case; and an electronic circuit that is connected to the acoustic generator.

* * * * *